US006360112B1

(12) United States Patent
Mizuno et al.

(10) Patent No.: US 6,360,112 B1
(45) Date of Patent: Mar. 19, 2002

(54) HIGH-FREQUENCY CIRCUIT ELEMENT HAVING A SUPERCONDUCTIVE RESONATOR TUNED BY ANOTHER MOVABLE RESONATOR

(75) Inventors: Koichi Mizuno; Akira Enokihara, both of Nara; Hidetaka Higashino, Kyoto; Kentaro Setsune, Osaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/415,153

(22) Filed: Oct. 8, 1999

Related U.S. Application Data

(62) Division of application No. 08/765,587, filed as application No. PCT/JP95/01168 on Jun. 9, 1995, now Pat. No. 6,016, 434.

(30) Foreign Application Priority Data

Jun. 17, 1994 (JP) ..... 6-135622

(51) Int. Cl.[7] ..... H01P 7/08; H01B 12/02

(52) U.S. Cl. ..... 505/210; 333/99 S; 333/235; 500/700; 500/701; 500/866

(58) Field of Search ..... 333/995, 235, 333/219, 205; 505/210, 700, 701, 866

(56) References Cited

U.S. PATENT DOCUMENTS

| | | | | |
|---|---|---|---|---|
| 3,117,379 A | | 1/1964 | Ayer | |
| 3,278,864 A | | 10/1966 | Butler | |
| 3,639,857 A | | 2/1972 | Okoshi et al. | |
| 5,136,268 A | | 8/1992 | Fiedziusko et al. | |
| 5,172,084 A | * | 12/1992 | Fiedziuszko et al. | 333/99 S |
| 5,391,543 A | * | 2/1995 | Higaki et al. | 333/99 S |
| 5,484,764 A | * | 1/1996 | Fiedziuszko et al. | 333/99 S |
| 6,016,434 A | * | 1/2000 | Mizuno et al. | 333/99 S |
| 6,239,674 B1 | * | 5/2001 | Enokihara et al. | 333/204 |

FOREIGN PATENT DOCUMENTS

| | | |
|---|---|---|
| EP | 0 516 440 | 5/1992 |
| EP | 0 509 636 | 10/1992 |
| EP | 0 522 515 | 1/1993 |

(List continued on next page.)

OTHER PUBLICATIONS

Wolff, J; "Microstrip Band pass filter using degenerate modes of a Microstrip Ring Resonator"; *Electronics Letters*; vol. 8, No. 12; Jun. 15, 1972; pp. 302, 303.*

S. Long et al. "The impedance of an elliptical printed–circuit antenna" Dept. Electrical Engineering University of Houston, Texas 77004, 1981 pp. 355–358.

Yasuhiro Nagai et al., "Properties of Disk Resonators and End–Coupled Disk Filters with Superconducting Films", *Japanese Journal of Applied Phusics*, vol. 32, No. 12A (Dec. 1993), pp. 5527–5531.

(List continued on next page.)

*Primary Examiner*—Benny T. Lee
(74) *Attorney, Agent, or Firm*—Merchant & Gould PC

(57) ABSTRACT

In a small transmission line type high-frequency circuit element that has small loss due to conductor resistance and has a high Q value, an error in the dimension of a pattern, etc. can be corrected to adjust element characteristics. An elliptical shape resonator (12) that is formed of an electric conductor is formed on a substrate (11*a*), while a pair of input-output terminals (13) are formed on a substrate (11*b*). Substrate (11*a*) on which resonator (12) is formed and substrate (11*b*) on which input-output terminal (13) is formed are located parallel to each other, with a surface on which resonator (12) is formed and a surface on which input-output terminal (13) is formed being opposed. Substrates (11*a*) and (11*b*) that are located parallel to each other are relatively moved by a mechanical mechanism that uses a screw and moves slightly. Also, substrate (11*a*) is rotated by the mechanical mechanism that uses a screw and moves slightly around the center axis of resonator (12) as a rotation axis (18).

7 Claims, 5 Drawing Sheets

FOREIGN PATENT DOCUMENTS

| | | | | |
|---|---|---|---|---|
| EP | 0 597 700 | | 11/1993 | |
| JP | 49-39542 | | 10/1974 | |
| JP | 49-122251 | | 11/1974 | |
| JP | 50-16454 | | 2/1975 | |
| JP | 51-18454 | | 2/1976 | |
| JP | 61-251203 | | 11/1986 | |
| JP | 1-60801 | | 7/1987 | |
| JP | 63-299010 | | 12/1988 | |
| JP | 2-17701 | | 1/1990 | |
| JP | 4-97602 | | 3/1992 | |
| JP | 4-339403 | | 11/1992 | |
| JP | 4-368006 | | 12/1992 | |
| JP | 5-199024 | | 8/1993 | |
| JP | 5-251904 | | 9/1993 | |
| JP | 5-267908 | | 10/1993 | |
| JP | 5-299914 | | 11/1993 | |
| JP | 6-37513 | | 2/1994 | |
| JP | 6-112701 | | 4/1994 | |
| JP | 4-287404 | | 10/1997 | |
| SU | 1688316 | * | 10/1991 | ..... 333/204 |
| SU | 1 688 316 | | 10/1991 | |

OTHER PUBLICATIONS

Communication from European Patent Office, European Search Report and Annexes.

J.A. Curtis et al., "Dual Mode Microstrip Filters" *Applied Microwave*, pp. 86–93.

* cited by examiner

HIGH-FREQUENCY CIRCUIT ELEMENT HAVING A SUPERCONDUCTIVE RESONATOR TUNED BY ANOTHER MOVABLE RESONATOR

This application is a Divisional of application Ser. No. 08/765,587, filed Dec. 17, 1996, now U.S. Pat. No. 6,016,434, which is a 371 of PCT/JP95/01168, filed Jun. 9, 1995, which application(s) are incorporated herein by reference.

TECHNICAL FIELD

The present invention relates to a high-frequency circuit element that basically comprises a resonator, such as a filter or a channel combiner, used for a high-frequency signal processor in communication systems, etc.

BACKGROUND ART

A high-frequency circuit element that basically comprises a resonator, such as a filter or a channel combiner, is an essential component in high-frequency communication systems. Especially, a filter that has a narrow band is required in mobile communication systems, etc. for the effective use of a frequency band. Also, a filter that has a narrow band, low loss, and small size and can withstand large power is highly desired in base stations in mobile communication and communication satellites.

The main examples of high-frequency circuit elements such as resonator filters presently used are those using a dielectric resonator, those using a transmission line structure, and those using a surface accoustic wave element. Among them, those using a transmission line structure are small and can be applied to wavelengths as low as microwaves or milliwaves. Furthermore, they have a two-dimensional structure formed on a substrate and can be easily combined with other circuits or elements, and therefore they are widely used. Conventionally, a half-wavelength resonator with a transmission line is most widely used as this type of resonator. Also, by coupling a plurality of these half-wavelength resonators, a high-frequency circuit element such as a filter is formed. (Laid-open Japanese Patent Applicant No. (Tokkai hei) 5-267908).

However, in a resonator that has a transmission line structure, such as a half-wavelength resonator, high-frequency current is concentrated in a part in a conductor. Therefore, loss due to conductor resistance is relatively large, resulting in degradation in Q value in the resonator, and also an increase in loss when a filter is formed. Also, when using a half-wavelength resonator that has a commonly used microstrip line structure, the effect of loss due to radiation from a circuit to space is a problem.

These effects are more significant in a smaller structure or at high operating frequencies. A dielectric resonator is used as a resonator that has relatively small loss and is excellent in withstanding high power. However, the dielectric resonator has a solid structure and large size, which are problems in implementing a smaller high-frequency circuit element.

Also, by using a superconductor that has a direct current resistance of zero as a conductor of a high-frequency circuit element using a transmission line structure, lower loss and an improvement in high frequency characteristics in a high-frequency circuit can be achieved. An extremely low temperature environment of about 10 degrees Kelvin was required for a conventional metal type superconductor. However, the discovery of a high-temperature oxide superconductor has made it possible to utilize the superconducting phenomena at relatively high temperatures (about 77 degrees Kelvin). Therefore, an element that has a transmission line structure and uses the high-temperature superconducting materials has been examined. However, in the above elements that have conventional structures, superconductivity is lost due to excessive concentration of current, and therefore it is difficult to use a signal having large power.

Thus, the inventors have implemented a small transmission line type high-frequency circuit element that has small loss due to conductor resistance and a high Q value, by using a resonator that is formed of a conductor disposed on a substrate and has two dipole modes orthogonally polarizing without degeneration as resonant modes.

Here, "two dipole modes orthogonally polarizing without degeneration" will be explained. In a common disk type resonator, a resonant mode in which positive and negative charges are distributed separately in the periphery of the disk is called a "dipole mode" and therefore is similarly called herein. When considering a two-dimensional shape, any dipole mode is resolved into two independent dipole modes in which the directions of current flow are orthogonal. If the shape of a resonator is a complete circle, the resonance frequencies of the two dipole modes orthogonally polarizing are the same. In this case, the energy of two dipole modes is the same, and the energy is degenerated. Generally, in the case of a resonator having any shape, the resonance frequencies of these independent modes are different, and therefore the energy is not degenerated. For example, when considering a resonator having an elliptical shape, two independent dipole modes orthogonally polarizing are respectively in the directions of the long axis and short axis of the ellipse, and the resonance frequencies of both modes are respectively determined by the lengths of the long axis and short axis of the ellipse. The "two dipole modes orthogonally polarizing without degeneration" refers to these resonant modes in a resonator having an elliptical shape, for example. When using a resonator that has thus two dipole modes orthogonally polarizing without degeneration as resonant modes, by separately using both modes, one resonator can be operated as two resonators that have different resonance frequencies. Therefore, the area of a resonator circuit can be effectively used, that is, a smaller resonator can be implemented. Also, when using this resonator, the resonance frequencies of two dipole modes are different, and therefore the coupling between both modes rarely occurs, rarely resulting in unstable resonance operation and degradation in Q value. In addition, this resonator has such a high Q value that the loss due to conductor resistance is small.

Generally, a resonator that has a transmission line structure and uses a thin film electrode pattern, regardless of whether a superconductor is used or not, has a two-dimensional structure formed on a substrate. Therefore, variations in element characteristics (for example, a difference in center frequency) due to an error in the dimension of a pattern etc. in patterning a transmission line structure occurs. Also, in the case of a resonator that has a transmission line structure and uses a superconductor, there is a problem that element characteristics are changed due to temperature change and input power, which is specific to superconductors, in addition to the problem of variations in element characteristics due to an error in the dimension of a pattern, etc. Therefore, the ability to adjust variations in element characteristics due to an error in the dimension of a pattern, etc. as well as a change in element characteristics due to temperature change and input power is required.

Laid-open Japanese Patent Application No. (Tokkai hei) 5-199024 discloses a mechanism that adjusts element characteristics. This adjusting mechanism disclosed in this official gazette comprises a structure in which a conductor piece, a dielectric piece, or a magnetic piece is located so that it can enter into the electromagnetic field generated by a high frequency flowing through a resonator circuit in a high-frequency circuit element comprising a superconducting resonator and a superconducting grounding electrode. According to this mechanism, by locating the conductor piece, the dielectric piece, or the magnetic piece close to or away from the superconducting resonator, a resonance frequency which is one of element characteristics can be easily adjusted.

However, in the high-frequency circuit element disclosed in the above Laid-open Japanese Patent Application No. (Tokkai hei) 5-199024, the shape of the superconducting resonator is a complete circle, and the resonance frequencies of two dipole modes orthogonally polarizing are the same. Therefore, both modes can not be utilized separately, and a smaller superconducting resonator and a smaller high-frequency circuit element can not be implemented.

In order to solve the above problems in the prior art, the present invention aims to provide a small transmission line type high-frequency circuit element that has small loss due to conductor resistance and has a high Q value, wherein an error in the dimension of a pattern, etc. can be corrected to adjust element characteristics. Also, the present invention aims to provide a high-frequency circuit element that can reduce a fluctuation in element characteristics due to temperature change and input power or can adjust element characteristics when a superconductor is used as a resonator.

SUMMARY OF THE INVENTION

According to an aspect of the present invention, a high-frequency circuit element comprises a resonator that is formed of an electric conductor disposed on a substrate and has a smooth outline shape and two dipole modes orthogonally polarizing without degeneration as resonant modes, and an input-output terminals that is coupled to an outer periphery of the resonator, wherein one of a dielectric, a magnetic body, and a conductor is located in a position opposed to the resonator. In the present invention, it is preferable to further provide a mechanism that changes the relative positions of the resonator and the dielectric, the magnetic body, or the conductor.

In the aspect of the present invention, a second resonator is preferably disposed on a surface of the dielectric. Further, the electric conductor comprising a resonator preferably has an elliptical shape.

In the aspect of the present invention, the resonator is preferably comprised of superconductor, or oxide superconductor.

In the aspect of the present invention, an electroconductive thin film is provided on the peripheral part of the resonator, wherein the electroconductive thin film is comprised of a material containing at least one metal selected from the group consisting of Au, Ag, Pt, Pd, Cu and Al, or a material formed by laminating at least two metals selected from the group consisting of Au, Ag, Pt, Pd, Cu and Al.

In the aspect of the present invention, according to the preferable example that a high-frequency circuit element comprises a resonator that is formed of an electric conductor formed on a substrate and has two dipole modes orthogonally polarizing without degeneration as resonant modes, and an input-output terminal that is coupled on the outer periphery of the resonator, wherein a dielectric, a magnetic body, or a conductor is located in a position opposed to the resonator, the following functions can be achieved. When the dielectric or the magnetic body is located near the resonator, the electromagnetic field distribution around the resonator changes. Therefore, by changing the relative positions of the dielectric or the magnetic body and the substrate, frequency characteristics such as a center frequency in operation as the resonator can be adjusted. As a result, variations in element characteristics due to an error in the dimension of a pattern, etc. in patterning a transmission line structure can be adjusted after manufacturing the high-frequency circuit element to implement a high-frequency circuit element that has high performance.

In the aspect of the present invention, according to the perferable example that a second resonator is disposed on a surface of the dielectric, each resonator is electrically coupled to the input-output terminal, and therefore the high-frequency circuit element can be operated as a notch filter or a band pass filter.

BRIEF DESCRIPTION OF THE DRAWINGS

FIG. 2(*b*) is a cross-sectional view of 2(*a*);

FIG. 2(*c*) is an exploded perspective view of FIG. 2(*a*);

FIG. 6(*b*) is a cross-sectional view of FIG. 6(*a*);

BEST MODE FOR CARRYING OUT THE INVENTION

The present invention will be described below in more detail using examples.

First Example

Figure 1:
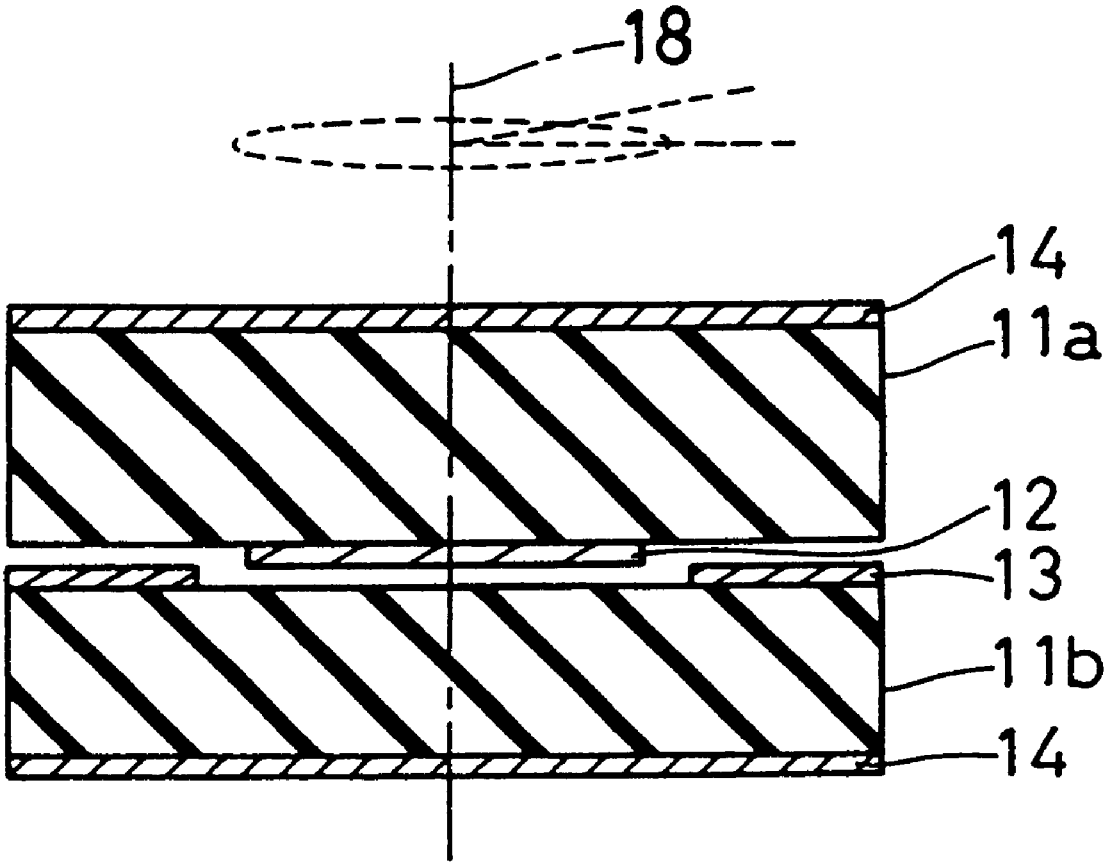
FIG. 1 is a cross-sectional view showing a first example of a high-frequency circuit element according to the present invention.

FIG. 1 is a cross-sectional view showing a first example of a high-frequency circuit element according to the present invention. As shown in FIG. 1, a resonator having an elliptical shape 12 which is formed of an electric conductor is formed on and at the center of a substrate 11*a* which is formed of a dielectric monocrystal, etc., by using a vacuum evaporation method and etching, for example. A pair of input-output terminals are formed on a substrate 11*b* which is formed of a dielectric monocrystal, etc., by using a vacuum evaporation method and etching, for example. Substrate 11*a* on which resonator 12 is formed and substrate 11*b* on which input-output terminal 13 is formed are located parallel to each other, with a surface on which resonator 12 is formed and a surface on which input-output terminal 13 is formed being opposed. By thus locating the substrate surface having resonator 12 formed and the substrate surface having input-output terminal 13 formed opposed and parallel to each other, good coupling of input-output terminal 13 and resonator 12 is obtained. In this case, if a gap exists between substrates 11*a* and 11*b*, there are no problems in principle. However, in order to improve the characteristics of the high-frequency circuit element, substrates 11*a* and 11*b* are in contact with each other. Thereby, one end of input-output terminal 13 is coupled to the outer periphery of resonator 12 by capacitance. Also, ground planes 14 are formed on the entire back surfaces of substrates 11*a* and 11*b*, and a high-frequency circuit element that has a triplate line structure as a whole is implemented. When using the triplate line structure, radiation loss is extremely small, and therefore a high-frequency circuit element that has small loss is obtained. In the high-frequency circuit element that is formed as mentioned above, resonance operation can be performed by coupling a high-frequency signal.

When considering a resonator having an elliptical shape as in this example, two independent dipole modes orthogonally polarizing are respectively in the directions of the long axis and short axis of the ellipse. The resonance frequencies of both modes are respectively determined by the lengths of the long axis and short axis of the ellipse. Therefore, in this case, the energies of two dipole modes are different and not degenerated. When using a resonator that has two such dipole modes orthogonally polarizing without degeneration as resonant modes, both modes can be separately used, and therefore one resonator can be operated as two resonators that have different resonance frequencies. As a result, the area of a resonator circuit can be effectively used, that is, a small-size resonator can be implemented. Also, when using this resonator, the resonance frequencies of two dipole modes are different, and therefore the coupling between both modes rarely occurs, rarely resulting in unstable resonance operation or degradation in Q value. In addition, such a high Q value leads to small loss due to conductor resistance.

Substrates 11*a* and 11*b* which are located parallel to each other can be relatively moved by a mechanical mechanism that uses a screw and moves slightly. Thereby, resonator 12 and input-output terminal 13 can be adjusted to be optimally coupled so that high frequencies can be processed. Also, substrate 11*a* can be rotated around the center axis (vertical direction) of resonator (ellipse) 12 as a rotation axis 18 by the mechanical mechanism that uses a screw and moves slightly. Thereby, the coupling positions of the pair of input-output terminals 13 and the outer peripheral part of resonator 12 can be changed, and therefore, by changing the coupling strength of the pair of input-output terminals 13 and each two modes orthogonally polarizing, a center frequency in operation as the resonator can be adjusted. Therefore, by suitably adjusting the relative positions of substrates 11*a* and 11*b* as well as the coupling position of resonator 12 and input-output terminal 13, element characteristics can be adjusted to implement a high-frequency circuit element that has high performance. Thus, according to the structure of this example, variations in element characteristics (for example, a difference in center frequency) due to an error in the dimension of a pattern, etc. in patterning a transmission line structure can be adjusted after manufacturing the high-frequency circuit element. Therefore, practical adjustment is possible compared with trimming a resonator pattern, etc.

While resonator 12 is formed on substrate 11*a*, and the pair of input-output terminals 13 are formed on substrate 11*b* in this example, a structure need not be limited to this structure. One input-output terminal 13 may be formed on substrate 11*a* having resonator 12 formed thereon. In this structure, element characteristics can be adjusted by changing the interval between the input-output coupling points of one input-output terminal 13 and of the other input-output terminal 13,.

Second Example

Figure 2:
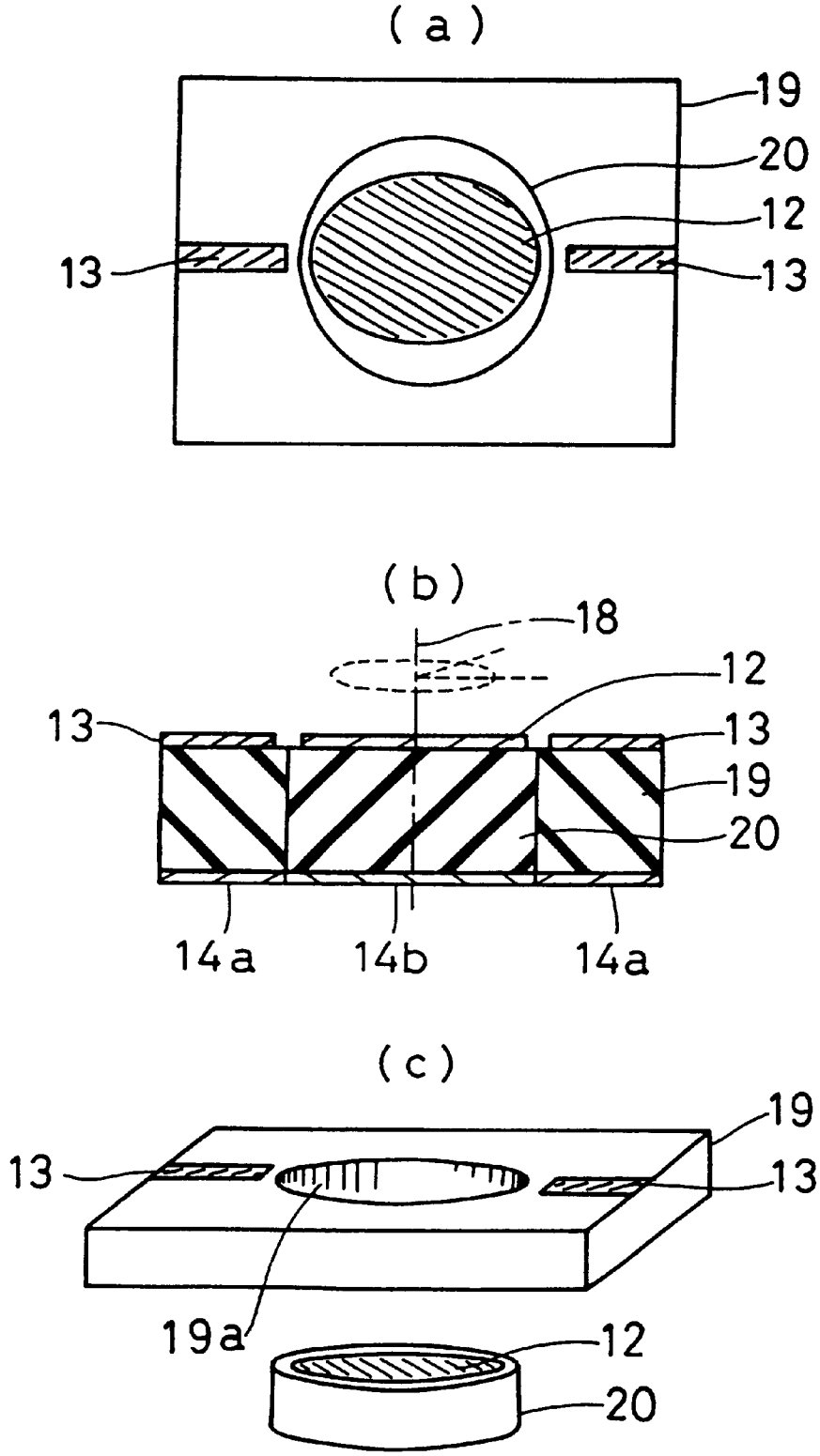
FIG. 2(*a*) is a plan view showing a second example of a high-frequency circuit element according to the present invention.

FIGS. 2(*a*)–2(*c*) are structural views showing a second example of a high-frequency circuit element according to the present invention. As shown in FIGS. 2(*a*)–2(*c*), a hole having a circular section 19*a* (see FIG. 2(*c*)) is provided at the center of a substrate 19 which is formed of a dielectric monocrystal, etc. A pair of input-output terminals 13 are formed on substrate 19 sandwiching hole 19*a* by using a vacuum evaporation method and etching, for example. A substrate 20 which is formed of the same material as that of substrate 19 is formed into a disk-like shape so that it can be fitted in hole 19*a* of substrate 19. A resonator having an elliptical shape 12 which is formed of an electric conductor is formed on substrate 20 by using a vacuum evaporation method and etching, for example. Substrate 20 is fitted in hole 19*a* of substrate 19 to be integrated. Thereby, one end of input-output terminal 13 is coupled to the outer peripheral part of resonator 12 by capacitance. Also, ground planes 14*a* and 14*b* (see FIG. 2(*b*)) are respectively formed on the entire back surfaces of substrates 19 and 20, and a high-frequency circuit element that has a microstrip line structure as a whole is implemented. This microstrip line structure is simple in structure and has good coherency with other circuits.

Substrate 20 can be relatively rotated around the center axis (vertical direction) of resonator (ellipse) 12 as a rotation axis 18 (see FIG. 2(*b*)) by a mechanical mechanism that uses a screw and moves slightly. Thereby, the coupling positions of the pair of input-output terminals 13 and the outer peripheral part of resonator 12 can be changed, and therefore, by changing the coupling strength of the pair of input-output terminals 13 and each two modes orthogonally polarizing, a center frequency in operation as the resonator can be similarly adjusted as in the above first example.

While the high-frequency circuit element that has a microstrip line structure is illustrated in this example, a structure need not be limited to this structure. A triplate line structure may be formed by locating a substrate that has a ground plane opposed to resonator 12 in this high-frequency circuit element. Also, a coplanar wave guide structure may be formed by manufacturing the entire structure including a ground plane on one surface of a substrate. By using this coplanar wave guide structure, manufacturing processes can be simplified, and the structure is especially effective when using a high-temperature superconducting thin film which is difficult to form on both surfaces of a substrate as a conductor material.

Third Example

Figure 3:
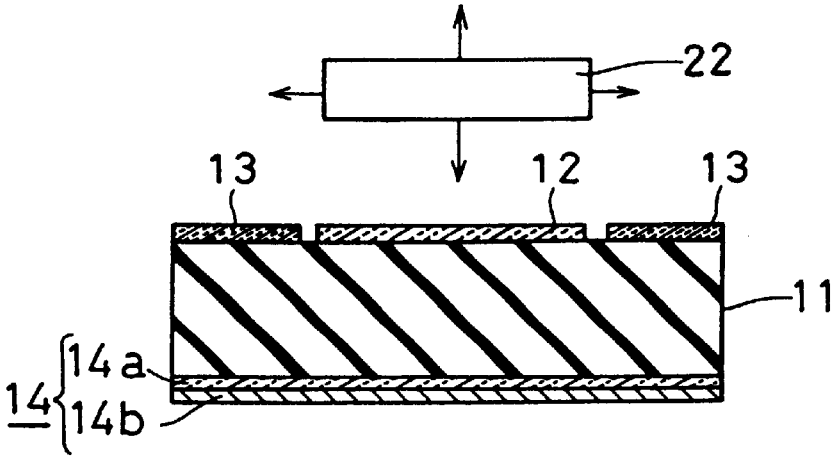
FIG. 3 is a cross-sectional view showing a third example of a high-frequency circuit element according to the present invention.

FIG. 3 is a cross-sectional view showing a third example of a high-frequency circuit element according to the present invention. As shown in FIG. 3, a resonator having an elliptical shape 12 which is formed of a superconductor is formed on and at the center of a substrate 11 which is formed of a dielectric monocrystal, etc. Also, a pair of input-output terminals 13 are formed on substrate 11 sandwiching resonator 12, and one end of input-output terminal 13 is coupled to the outer peripheral part of resonator 12 by capacitance. Also, a dielectric 22 is located near substrate 11 and at a position opposed to resonator 12. Dielectric 22 may have any shape and is independently held so that it can be relatively displaced with respect to resonator 12. The displacement of dielectric 22 is achieved by a mechanical mechanism that uses a screw and moves slightly. A ground plane 14 is formed on the entire back surface of substrate 11, and a high-frequency circuit element that has a microstrip line structure as a whole is implemented. Here, ground plane 14 has a two-layer structure of a superconductor layer 14*a* and an Au layer 14*b*.

When dielectric 22 is located near resonator 12 as mentioned above, the electromagnetic field distribution around resonator 12 changes. Therefore, by changing the relative positions of dielectric 22 and substrate 11, frequency characteristics such as a center frequency in operation as the resonator can be adjusted. In other words, by suitably adjusting the relative positions of resonator 12 and dielectric 22 by this mechanism that moves slightly, a high-frequency circuit element that has high performance can be obtained.

While dielectric 22 is located at a position opposed to resonator 12 in this example, the structure need not be limited to this structure. By locating a magnetic body or a conductor instead of dielectric 22 and changing its relative position, frequency characteristics such as a center frequency in operation as the resonator can be adjusted. Also, when a resonator is formed on a surface of dielectric 22 opposed to resonator 12, each resonator is electrically coupled to input-output terminal 13, and a notch filter or a band pass filter can be formed. Also, in this case, the characteristics of each filter can be adjusted by displacing the relative positions of resonator 12 and dielectric 22.

While the coupling of one end of input-output terminal and the outer peripheral part of resonator 12 is capacitance coupling in this example, a structure need not be limited to this structure. The coupling may be inductance coupling.

Fourth Example

Figure 4:
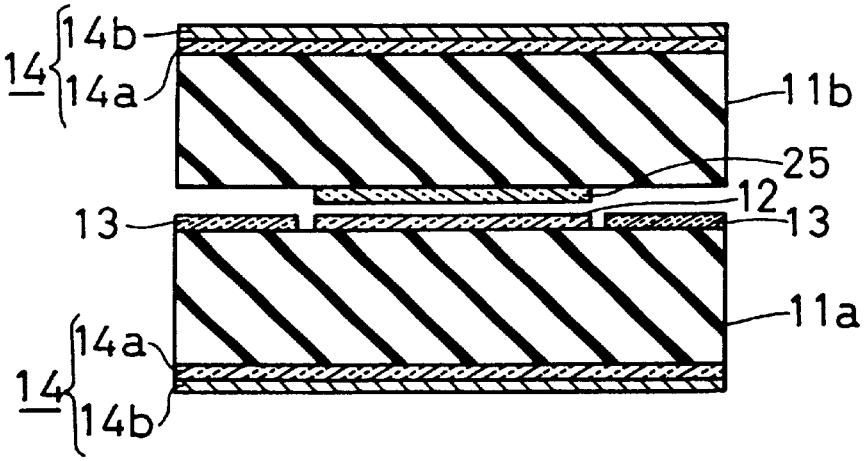
FIG. 4 is a cross-sectional view showing a fourth example of a high-frequency circuit element according to the present invention.

FIG. 4 is a cross-sectional view showing a fourth example of a high-frequency circuit element according to the present invention. As shown in FIG. 4, a resonator having an elliptical shape 12 which is formed of a superconductor is formed on and at the center of a substrate 11*a* which is formed of a dielectric monocrystal, etc. Also, a pair of input-output terminals 13 are formed on substrate 11*a* sandwiching resonator 12, and one end of input-output terminal 13 is coupled to the outer peripheral part of resonator 12 by capacitance. A resonator having an elliptical shape 25 which is formed of a superconductor is formed on and at the center of a substrate 11*b* which is formed of the same material as that of substrate 11*a*. Substrates 11*a* and 11*b* are located parallel to each other, with a surface on which resonator 12 is formed and a surface on which resonator 25 is formed being opposed. Also, ground planes 14 are formed on the entire back surfaces of substrates 11*a* and 11*b*, and a high-frequency circuit element that has a strip line structure as a whole is implemented. Here, ground plane 14 has a two-layer structure of a superconducting layer 14*a* and an Au layer 14*b*.

Substrates 11*a* and 11*b* which are located parallel to each other can be relatively moved by a mechanism that moves slightly. This mechanism that moves slightly can be achieved by mechanical means using a screw and is capable of parallel movement in the directions of three axes and rotating movement.

The above structure can be used as a kind of notch filter. However, by rotating one substrate 11*a* (or 11*b*) with respect to the other substrate 11*b* (or 11*a*), with the center axis of resonator (ellipse) 12 or resonator (ellipse) 25 as the rotation axis, and changing the coupling positions of respective two modes of two resonators 12 and 25 and input-output terminal 13, frequency characteristics such as a center frequency in operation as the resonator can be adjusted. In other words, by suitably adjusting the relative positions of substrates 11*a* and 11*b* using this mechanism that moves slightly, a center frequency can be optimized.

Fifth Example

Figure 5:
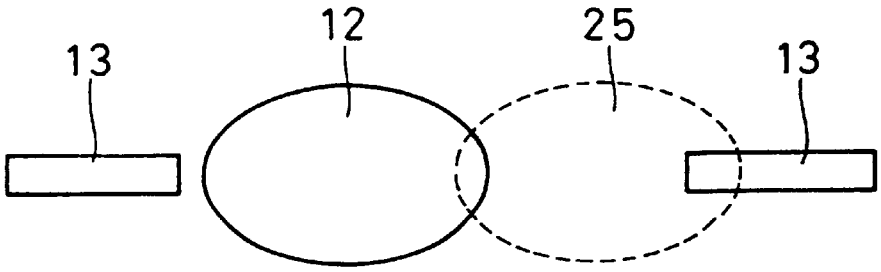
FIG. 5 is a conceptual view showing a fifth example of the high-frequency circuit element according to the present invention.

FIG. 5 shows a conceptual view of a high-frequency circuit element in which two substrates are similarly located opposed to each other as in the above fourth example. In FIG. 5, solid lines represent a resonator pattern (an ellipse type resonator 12 which is formed of a superconductor herein) and a pair of input-output terminals 13 which are formed on one substrate, while a broken line represents a resonator pattern (an ellipse type resonator 25 which is formed of a superconductor herein) which is formed on the other substrate. A gap is provided between each substrate, and by coupling the substrates to each other so that high frequencies can be processed, a multi-stage band pass filter is implemented. Each substrate that is located opposed to and parallel to each other can be relatively moved in parallel. Therefore, by changing the relative position of each substrate and changing the coupling between each substrate in which high frequencies can be processed, the frequency characteristics of the multi-stage band pass filter can be adjusted.

While a filter formed on each substrate is coupled one by one in this example, a structure need not be limited to this structure. A plurality of filters may be coupled. While the pair of input-output terminals 13 are formed on one substrate in this example, a structure need not be limited to this structure. The pair of input-output terminals 13 may be separately formed on both substrates. By combining these structures, a high-frequency circuit element that has various characteristics can be obtained.

While the superconductor is used as a resonator material to achieve low loss in the above third to fifth examples, the resonator material may be any electric conductor in principle.

While the mechanical means using a screw is used as a mechanism that moves slightly in the above third to fifth examples, a structure need not be limited to this structure. Other means may be used. When using mechanical means as a mechanism that moves slightly, element characteristics can be adjusted while the high-frequency circuit element is operated, and therefore practical adjustment is possible compared with trimming a resonator pattern.

Sixth Example

Figure 6:
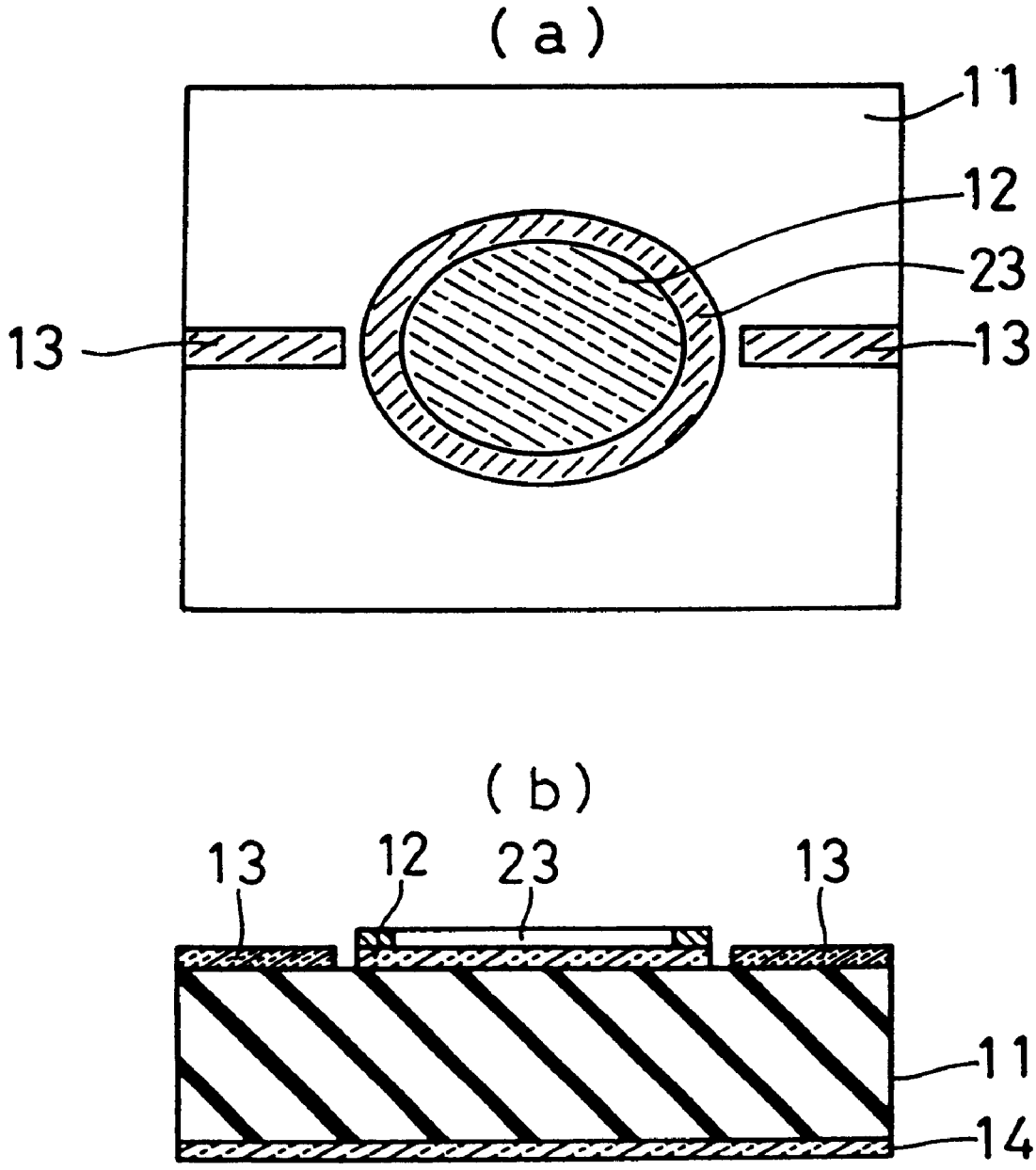
FIG. 6(*a*) is a plan view showing the fifth example of the high-frequency circuit element according to the present invention.

FIGS. 6(*a*) and 6(*b*) show a sixth example of a high-frequency circuit element according to the present invention. As shown in FIGS. 6(*a*) and 6(*b*), a resonator having an elliptical shape 12 which is formed of a superconductor is formed on and at the center of a substrate 11 which is formed of a dielectric monocrystal, etc. Also, a pair of input-output terminals 13 are formed on substrate 11 sandwiching resonator 12, and one end of input-output terminal 13 is coupled to the outer peripheral part of resonator 12 by capacitance. Also, a ground plane 14 (see FIG. 6(*b*)) is formed on the entire back surface of substrate 11, and a high-frequency circuit element that has a microstrip line structure as a whole is implemented.

An electroconductive thin film having a ring-like shape 23 is formed on the peripheral part of resonator (superconductor) 12.

Various characteristics of the superconductor such as penetration depth and kinetic inductance are temperature functions. These characteristics change greatly with respect to small temperature changes, especially in a temperature range near a transition temperature Tc, and these values are factors that change frequency characteristics in high-frequency application. Since penetration depth determines current distribution in the peripheral part of resonator 12, it is required to reduce temperature change or to reduce current distribution change in the peripheral part with respect to temperature fluctuation. With respect to the temperature change to the extent of temperature fluctuation, which is a problem here, the change of characteristics in electroconductive material such as metal is negligible. Therefore, by forming an electroconductive thin film having a ring-like shape 23 on the peripheral part of ring-like resonator 12, the effects of temperature fluctuation on high-frequency characteristics are reduced. Also, when a high-frequency signal having large power is processed, large current flows through the peripheral part of resonator 12. However, by forming electroconductive thin film 23 on the peripheral part of resonator 12 as in this example, a part of the current flowing through the peripheral part of resonator (superconductor) 12 flows through electroconductive thin film 23, and therefore power conditions in which the superconductivity of the superconductor is lost, returning to the normal conducting state, can be eased. When forming an electroconductive material on and in contact with the superconductor, high frequency loss increases. However, the electroconductive material does not exist at the center part of ellipse type resonator 12, and therefore its effects are minimized. In other words, according to the structure of this example, a high-frequency circuit element that has lower loss compared with those in which an electroconductive thin film is formed in contact with the entire surface of a resonator formed of a superconductor can be obtained. Furthermore, when the superconductivity of the superconductor is lost due to some factor and assumes the normal conducting state, high-frequency power flows through electroconductive thin film 23, and therefore extreme deterioration in characteristics is prevented.

In the high-frequency circuit element explained in this example, a metal thin film can be used as the electroconductive thin film 23. Examples of metal materials are preferably materials that have good electroconductivity. Particularly when using a material containing at least one metal selected from Au, Ag, Pt, Pd, Cu, and Al, or a material formed by laminating at least two metals selected from Au, Ag, Pt, Pd, Cu, and Al, good electroconductivity is obtained, and such materials are advantageous to application to high frequencies. Furthermore, these materials are chemically stable and have low reactivity and small effects to other materials. Therefore, they are advantageous to form in contact with various materials, especially superconducting materials.

As the superconducting material used as resonator 12 in this example has much smaller loss compared with metal materials, a resonator that has a very high Q value can be implemented. Therefore, the use of a superconductor in the high-frequency circuit element in the present invention is effective. Examples of this superconductor may be metal type materials (for example, Pb type materials such as Pb and PbIn, Nb type materials such as Nb, NbN, $Nb_3Ge$). However, in practical, it is preferable to use high-temperature oxide superconductors that have relatively mild temperature conditions (for example, $YBa_2Cu_3O_7$).

While the coupling of one end of input-output terminal 13 and the peripheral part of resonator 12 is capacitance coupling in this example, a structure need not be limited to this structure. The coupling may be inductance coupling.

While the electric conductor or superconductor having an elliptical shape is used as the resonator in the above first to sixth examples, a structure need not be limited to this structure. Planar circuit resonators having any shape can be, basically, similarly operated if these resonators have two dipole modes orthogonally polarizing without degeneration as resonant modes. However, if the outline of the electric conductor or the superconductor is not smooth, high-frequency current is excessively concentrated in a part, and a Q value is reduced due to an increase in loss. So, problems may occur when a high-frequency signal having large power is processed. Therefore, when using a shape other than an elliptical shape, effectivity can be further improved by forming a resonator with an electric conductor or superconductor that has a smooth outline.

While the pair of input-output terminals 13 are coupled to resonator 12 in the above first to sixth examples, a structure need not be limited to this structure. At least one input-output terminal 13 needs to be coupled to resonator 12.

Seventh Example

Figure 7:
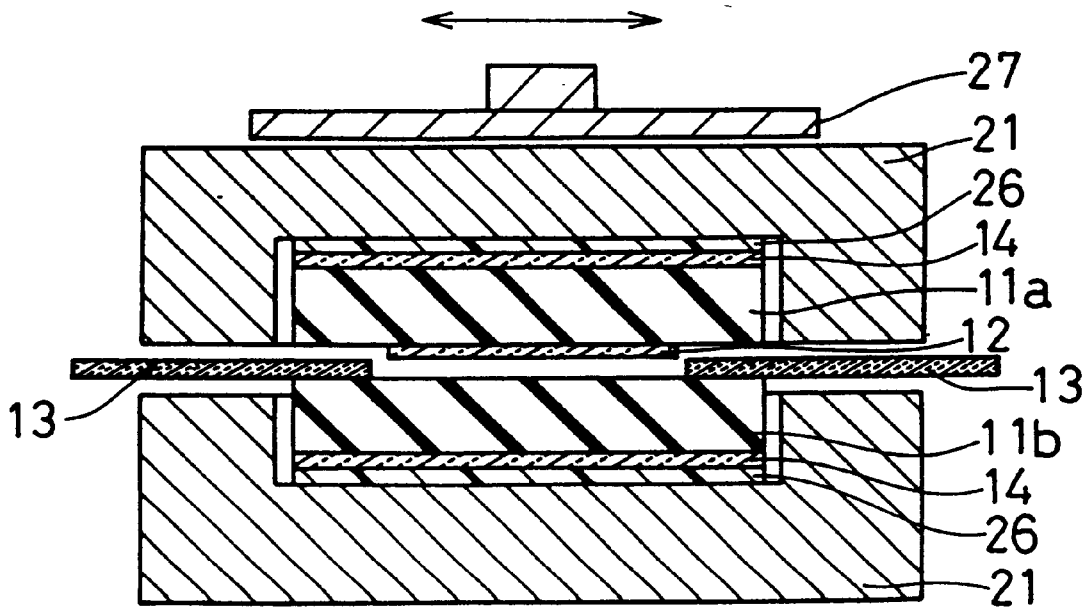
FIG. 7 is a cross-sectional view showing one aspect of a seventh example of a high-frequency circuit element according to the present invention.

FIG. 7 shows a structure of a high-frequency circuit element manufactured in this example. A resonator 12 is an ellipse type conductor plate. The diameter of resonator 12 is about 7 mm, and the ellipticity and the gap of input-output coupling are set so that the band width is about 2%. The manufacturing method of the high-frequency circuit element is as follows. First, a high-temperature oxide superconducting thin film that has a thickness of 1 $\mu$m was formed on both surfaces of substrates 11*a* and 11*b* which are formed of monocrystal of lanthanum alumina ($LaAlO_3$). This high-temperature oxide superconductor is one that is commonly called a Hg type oxide superconductor, and primarily, a $HgBa_2CuO_x$ (1201 phases) thin film was used. This thin film showed superconducting transition at 90 degrees Kelvin or higher. Then, an Au thin film that has a thickness of 1 $\mu$m was deposited on back surfaces of both substrates 11*a* and 11*b* by a vacuum evaporation method to form ground planes 14 which are formed of a high-temperature oxide superconducting thin film and an Au thin film. Then, by photolithography and argon ion beam etching methods, resonator 12 which is formed of a high-temperature oxide superconducting thin film was patterned on a surface, opposite to the surface having ground plane 14 formed, of one substrate 11*a*, while a pair of input-output terminals 13 which are similarly formed of a high-temperature oxide superconducting thin film were patterned on a surface, opposite to the surface having ground plane 14 formed, of the other substrate 11*b*. Then, substrates 11*a* and 11*b* were located parallel to each other, with the surface on which resonator 12 is formed and the surface on which input-output terminal 13 is formed being opposed, in a copper package 21 whose surfaces are plated with Au. Thereby, a high-frequency circuit element that has a triplate line structure as a whole was implemented. Here, package 21 and ground plane 14 are adhered by a conducting paste 26 (an Ag paste was used in this example), so that thermal conductivity and an electric ground are ensured. Although some gap exists between substrates 11*a* and 11*b* in FIG. 7, both substrates 11*a* and 11*b* are actually superimposed.

Temperature monitoring was performed by contacting an AuFechromel thermocouple with package 21, and determining thermoelectromotive force. Then, the temperature was adjusted by cooling the entire package 21 by a small refrigerating machine that can electrically control output (not shown), and feedbacking a control signal corresponding to the thermoelectromotive force with respect to the refrigerating machine.

A mechanism 27 that moves slightly is provided for package 21. By adjusting this mechanism 27 that moves slightly, resonator 12 can be displaced in a horizontal direction with respect to the substrate surface having input-output terminal 13 formed, and can be displaced in the direction of rotation around the center axis (vertical direction) of resonator 12 as the rotation axis. Thus, it is possible to adjust resonator 12 and input-output terminal 13 to the positions where optimal input-output coupling is obtained.

Figure 8:
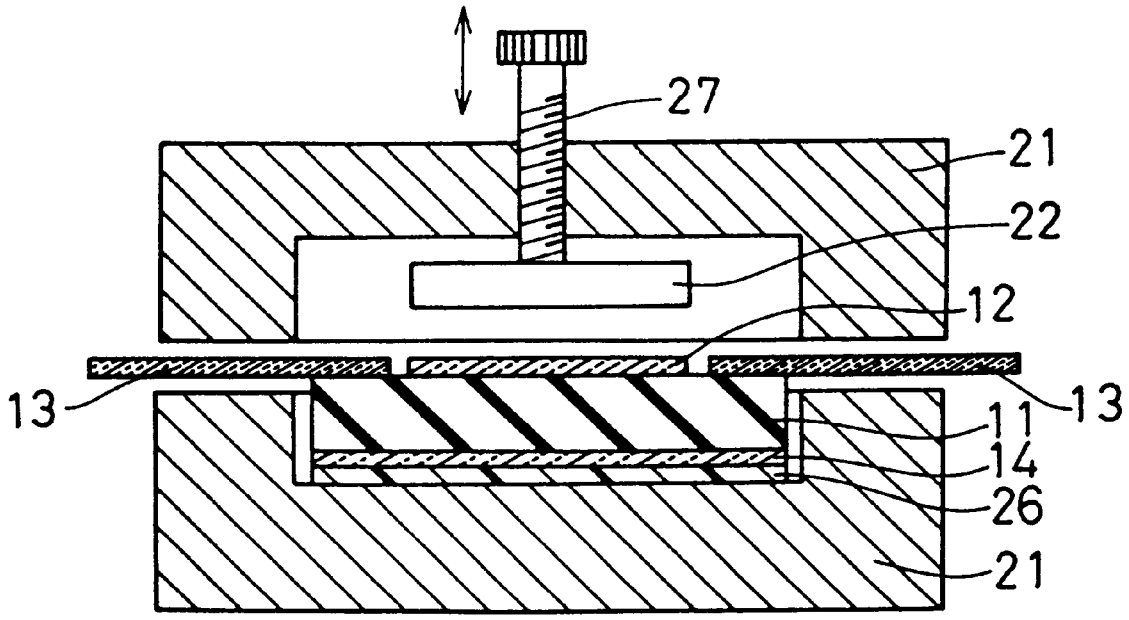
FIG. 8 is a cross-sectional view showing another aspect of a seventh example of a high-frequency circuit element according to the present invention.

FIG. 8 shows another structure of a high-frequency circuit element manufactured in this example. A resonator 12 is an ellipse type conductor plate. The diameter of resonator 12 is about 7 mm, and the ellipticity and the gap of input-output coupling are set so that the band width is about 2%. The manufacturing method of the high-frequency circuit element is as follows. First, a high-temperature oxide superconducting thin film that has a thickness of 1 $\mu$m was formed on both surfaces of substrate 11 which is formed of monocrystal of lanthanum alumina ($LaAlO_3$). This high-temperature oxide superconductor is one that is commonly called a Hg type oxide superconductor, and primarily, a $HgBa_2CuO_x$ (1201 phases) thin film was used. This thin film showed superconducting transition at 90 degrees Kelvin or higher. Then, an Au thin film that has a thickness of 1 $\mu$m was deposited on the back surface of substrate 11 by a vacuum evaporation method to form a ground plane 14 which is formed of a high-temperature oxide superconducting thin film and an Au thin film. Then, by photolithography and argon ion beam etching methods, resonator 12 which is formed of a high-temperature oxide superconducting thin film and a pair of input-output terminals 13 were patterned on a surface, opposite to the surface on which ground plane 14 is formed, of substrate 11. Thereby, a high-frequency circuit element that has a microstrip line structure as a whole was implemented. Then, substrate 11 was located in a copper package 21 whose surfaces are plated with Au, and a disk-like dielectric made of polytetrafluoroethylene 22 was located at a position opposed to resonator 12. Package 21 and ground plane 14 are adhered by a conducting paste 26 (an Ag paste was used in this example), so that thermal conductivity and an electric ground are ensured.

Temperature monitoring was performed by contacting an AuFechromel thermocouple with package 21, and determining thermoelectromotive force. Then, the temperature was adjusted by cooling the entire package 21 by a small refrigerating machine that can electrically control output, and feedbacking a control signal corresponding to the thermoelectromotive force with respect to the refrigerating machine.

A mechanism 27 that moves slightly is provided for package 21. By adjusting this mechanism 27 that moves slightly, the gap between dielectric 22 and resonator 12 can be changed a little to adjust the characteristics of resonator 12.

While the dielectric made of polytetrafluoroethylene is used as dielectric 22 in this example, a structure need not be limited to this. Other dielectric materials may be used.

Industrial Availability

As mentioned above, according to the high-frequency circuit element according to the present invention, in a small transmission line type high-frequency circuit element that has a high Q value, an error in the dimension of a pattern, etc. can be corrected to adjust element characteristics, and a fluctuation in element characteristics due to temperature change and input power can be reduced or element characteristics can be adjusted when a superconductor is used as a resonator. Therefore, this high-frequency circuit element can be used for a base station in mobile communication or a communication satellite which requires a filter that can withstand large power.

What is claimed is:

1. A high-frequency circuit element comprising a resonator that is comprised of an electric conductor disposed on a substrate and having a disk shape with smooth outline and two dipole modes orthogonally polarizing without degeneration as resonant modes, and an input-output terminal that is coupled to an outer periphery of said resonator, wherein a second dielectric on which a second resonator is disposed is located in a position opposed to said resonator, further comprising a mechanism that changes the relative positions of the resonator and the second dielectric.

2. The high-frequency circuit element according to claim 1, wherein the second resonator is comprised of a superconductor.

3. The high-frequency circuit element according to claim 1, wherein the second resonator is comprised of an oxide superconductor.

4. The high-frequency circuit element according to claim 1, wherein both the resonator and the second resonator are comprised of a superconductor.

5. The high-frequency circuit element according to claim 1, wherein the electric conductor of the smooth shape has an elliptical shape.

6. The high-frequency circuit element according to claim 1, wherein the resonator is comprised of a superconductor.

7. The high-frequency circuit element according to claim 1, wherein the resonator is comprised of an oxide superconductor.

* * * * *